US008365560B2

(12) United States Patent
Domit

(10) Patent No.: US 8,365,560 B2
(45) Date of Patent: Feb. 5, 2013

(54) LOCK KEY MECHANISM

(76) Inventor: Antonio Domit, San Antonio, TX (US)

( * ) Notice: Subject to any disclaimer, the term of this patent is extended or adjusted under 35 U.S.C. 154(b) by 0 days.

(21) Appl. No.: 12/726,132

(22) Filed: Mar. 17, 2010

(65) Prior Publication Data

US 2011/0000267 A1 Jan. 6, 2011

(51) Int. Cl.
*E05B 19/00* (2006.01)

(52) U.S. Cl. ..... 70/395; 70/397; 70/398; 70/401; 70/416; 70/419

(58) Field of Classification Search ..... 70/389, 70/395, 397–399, 401, 416, 419
See application file for complete search history.

(56) References Cited

U.S. PATENT DOCUMENTS

| | | | | | |
|---|---|---|---|---|---|
| 485,899 | A * | 11/1892 | Tannenberg | 70/221 |
| 1,382,826 | A * | 6/1921 | Dove | 70/358 |
| 2,019,400 | A * | 10/1935 | Deutsch | 70/411 |
| 2,440,429 | A * | 4/1948 | Best | 70/395 |
| 2,662,390 | A * | 12/1953 | Michnoff et al. | 70/428 |
| 3,276,233 | A * | 10/1966 | Russell et al. | 70/382 |
| 3,475,934 | A * | 11/1969 | Reisner | 70/428 |
| 3,797,291 | A * | 3/1974 | Simorghi | 70/395 |
| 3,857,264 | A * | 12/1974 | Fowler | 70/423 |
| 4,120,184 | A * | 10/1978 | Gerlach | 70/389 |
| 4,296,616 | A * | 10/1981 | Guiler | 70/34 |
| 4,840,049 | A * | 6/1989 | Russo | 70/34 |
| 5,076,081 | A * | 12/1991 | Boris, Jr. | 70/398 |
| 5,355,702 | A * | 10/1994 | Escribens | 70/395 |
| 6,209,370 | B1 * | 4/2001 | Larson et al. | 70/389 |
| 6,378,345 | B1 * | 4/2002 | Lin | 70/409 |
| 6,776,016 | B1 * | 8/2004 | Wittwer et al. | 70/252 |
| 6,935,147 | B1 * | 8/2005 | St. Felix | 70/432 |
| 6,986,272 | B2 * | 1/2006 | Sandvoss et al. | 70/409 |
| 7,021,095 | B2 * | 4/2006 | Jensen | 70/389 |
| 7,334,441 | B1 * | 2/2008 | Amundson et al. | 70/252 |
| 7,581,422 | B2 * | 9/2009 | Schindler | 70/252 |
| 2003/0101782 | A1 * | 6/2003 | Wendt | 70/394 |

* cited by examiner

*Primary Examiner* — Suzanne Barrett
(74) *Attorney, Agent, or Firm* — Roger N. Chauza, PC

(57) ABSTRACT

A key mechanism that makes it possible to fix the key inside the cylinder bolt lock outphased from the original combination, thereby preventing the cylinder of the bolt lock from turning. The security of the key mechanism is also enhanced as a cylinder tumbler engages within a slot of the key blade and the key cannot then be expelled from the cylinder bolt lock. Therefore, it is impossible to insert another key or pick-lock from the other side of the cylinder bolt lock.

15 Claims, 12 Drawing Sheets

LOCK KEY MECHANISM

PRIORITY CLAIM

This application is based on and claims the benefit of priority from Mexican Patent Application No. MX/a/2009/002955 filed Mar. 19, 2009, the contents of which are incorporated by reference.

BACKGROUND OF THE INVENTION

Currently, the locking keys address different functions for securing a door by means of a lock with designs differing in the form and size of the key that is used, as well as the specific type of lock. This makes it necessary to have many different keys for locks, but at no time is the key a securing device for the lock, but only the means to obtain access to the locking and/or the unlocking of such lock.

In order to solve the problem of not having a mechanism where the same key also becomes a latch to secure the lock, the key mechanism of the invention fixes the key within the cylinder bolt lock in an incorrect position when so desired, so that the same key prevents the insertion of either another key or picklock into the cylinder bolt lock, as the cylinder gets blocked. This prevents the other key from turning the cylinder bolt lock and thus the key mechanism works as a locking device. In this way, the key mechanisms secure the key in an advanced or retarded position within the cylinder bolt lock, outphased from the proper combination, to prevent the cylinder bolt lock from unlocking when so desired.

It is important to note that if the bolt lock consists of two cylinders, one at the inside of the door and the other cylinder at the outside of the door, it is necessary that the key is pushed further into the inside cylinder bolt lock from the location beyond the proper combination, so that the tip of the key snaps and prevents the cylinder bolt lock on the other side from turning. If the cylinder bolt lock comprises a single cylinder, the key will be in a forward or retracted position to prevent synchronization of the tumbler bolts with the correct combination.

SUMMARY OF THE INVENTION

The present invention relates to a key mechanism that is able to be fixed inside the cylinder bolt lock in a position outphased from the operational combination, so that the cylinder of the bolt lock cannot turn, and the key cannot be pushed out of the cylinder bolt lock from the other side. This prevents the input of any kind of key or picklock from the other side of the cylinder bolt lock.

The purpose of the present invention is to provide a security means different from the keys and locks already known, through the provision of a securing key. The key mechanism is the same and only key for the cylinder bolt lock which, upon being inserted into the cylinder of a conventional bolt lock to a position, the key mechanism unlocks and locks the cylinder bolt lock, and when inserted further to another position, the cylinder bolt lock is prevented from being unlocked.

DETAILED DESCRIPTION OF THE INVENTION

The key mechanism of the invention furthers the purpose of securing the cylinder bolt lock because it can be inserted into the cylinder of the bolt lock and fixed at such position where the proper combination is not achieved. This can be achieved by inserting the key into the cylinder bolt lock, be it either more than necessary or less than necessary, to prevent the correct combination within the cylinder. With this arrangement, the key mechanism will occupy the chamber or key slot of the cylinder bolt lock, thus preventing another key or picklock from being inserted from the other side and opening the cylinder bolt lock. The key also remains fixed in the cylinder bolt lock so it cannot be pushed out from the other side of the cylinder bolt lock. To prevent the securing key mechanism from being pushed out of the cylinder bolt lock, one of the combination tumblers of the cylinder bolt lock will fall into an opened slot of the key, thus securing the key and fixing it in a position out of the proper combination of the cylinder bolt lock, thus preventing the cylinder from turning.

The foregoing can be accomplished in several ways. Accordingly, two key mechanisms are proposed herein, consisting of several moving components which are coupled together.

Mechanism 1

Figure 6:
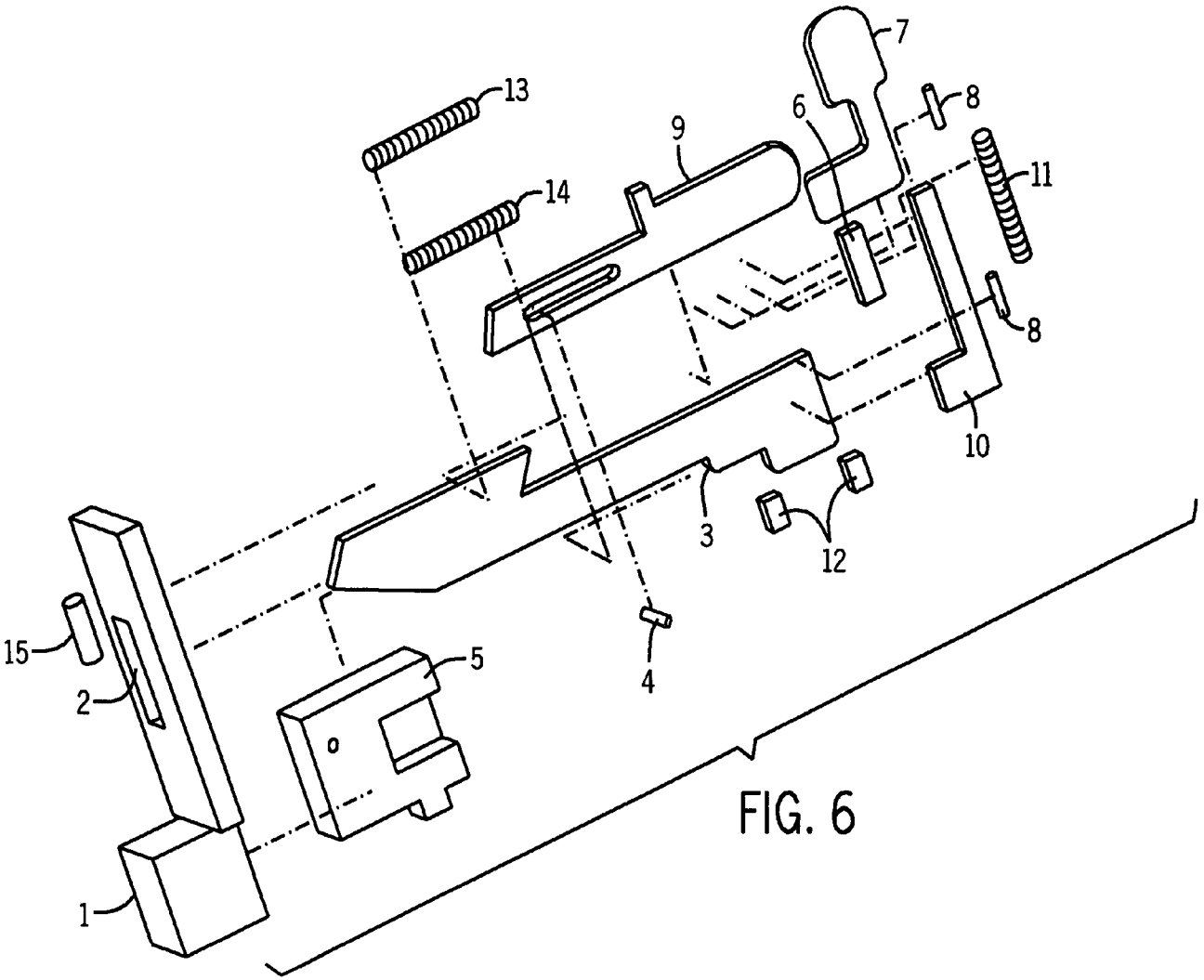
FIG. 6 is an exploded view of the first key mechanism according to the invention.
Figure 7:
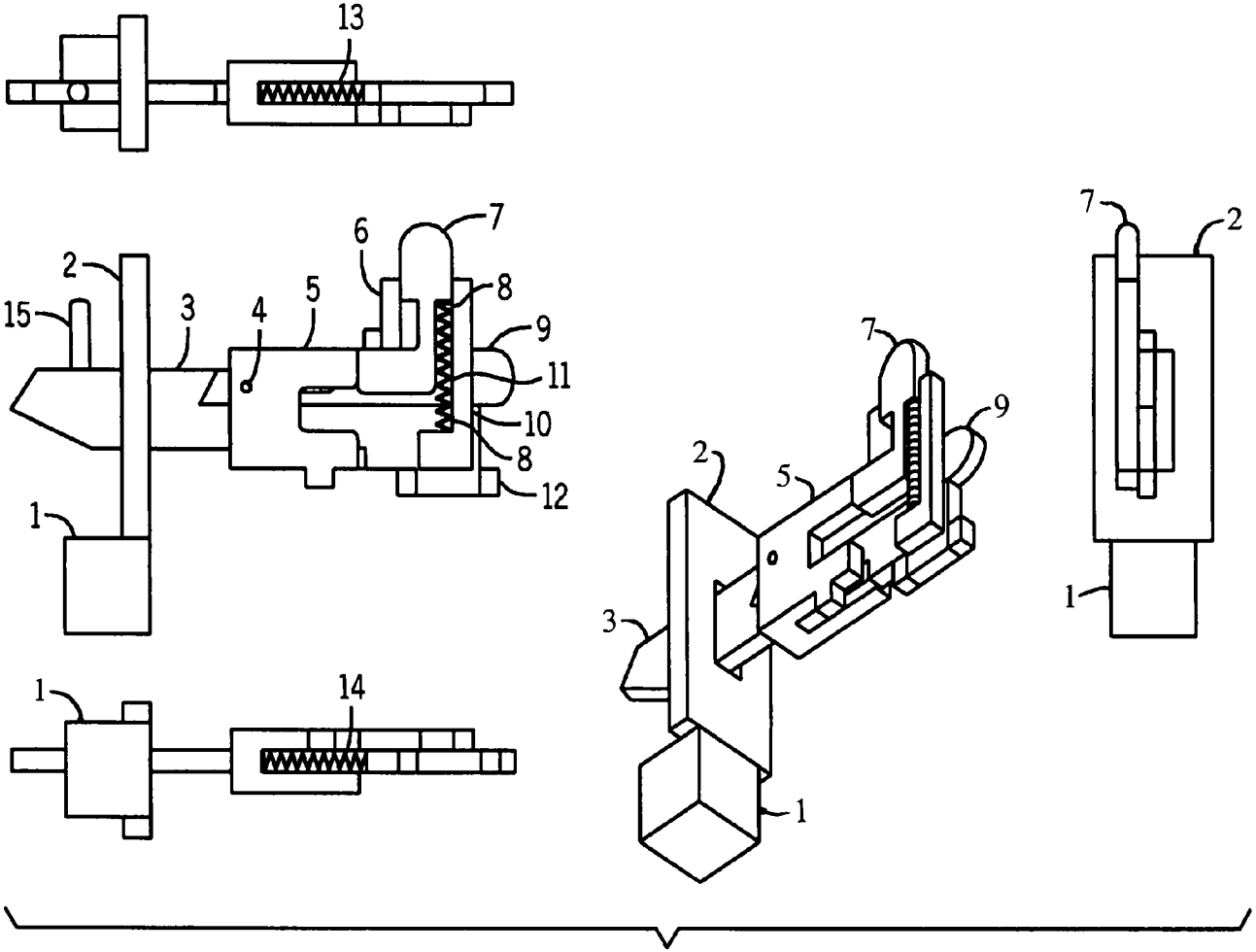
FIG. 7 shows top, side, bottom, isometric and back end views of the first key mechanism.

The key mechanism 1 comprises ten moving components and three springs, where all the components are mounted on a mounting bracket. The first key mechanism includes the combination of the original key to unlock the cylinder bolt lock (FIGS. 6 and 7).

Figure 8:
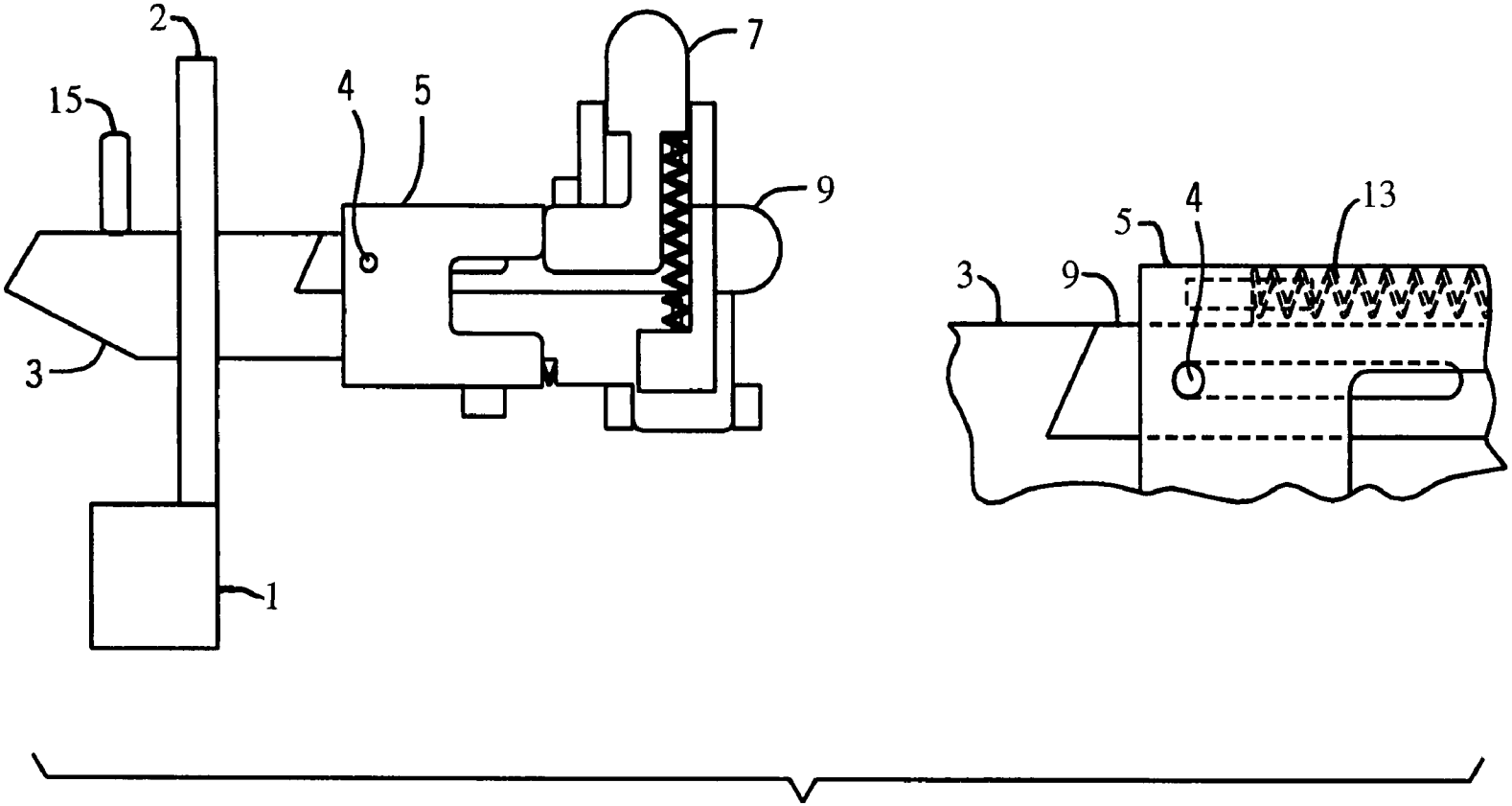
FIG. 8 is a side view and partial enlarged view of the first key mechanism where the key blade is entering the cylinder bolt lock.
Figure 9:
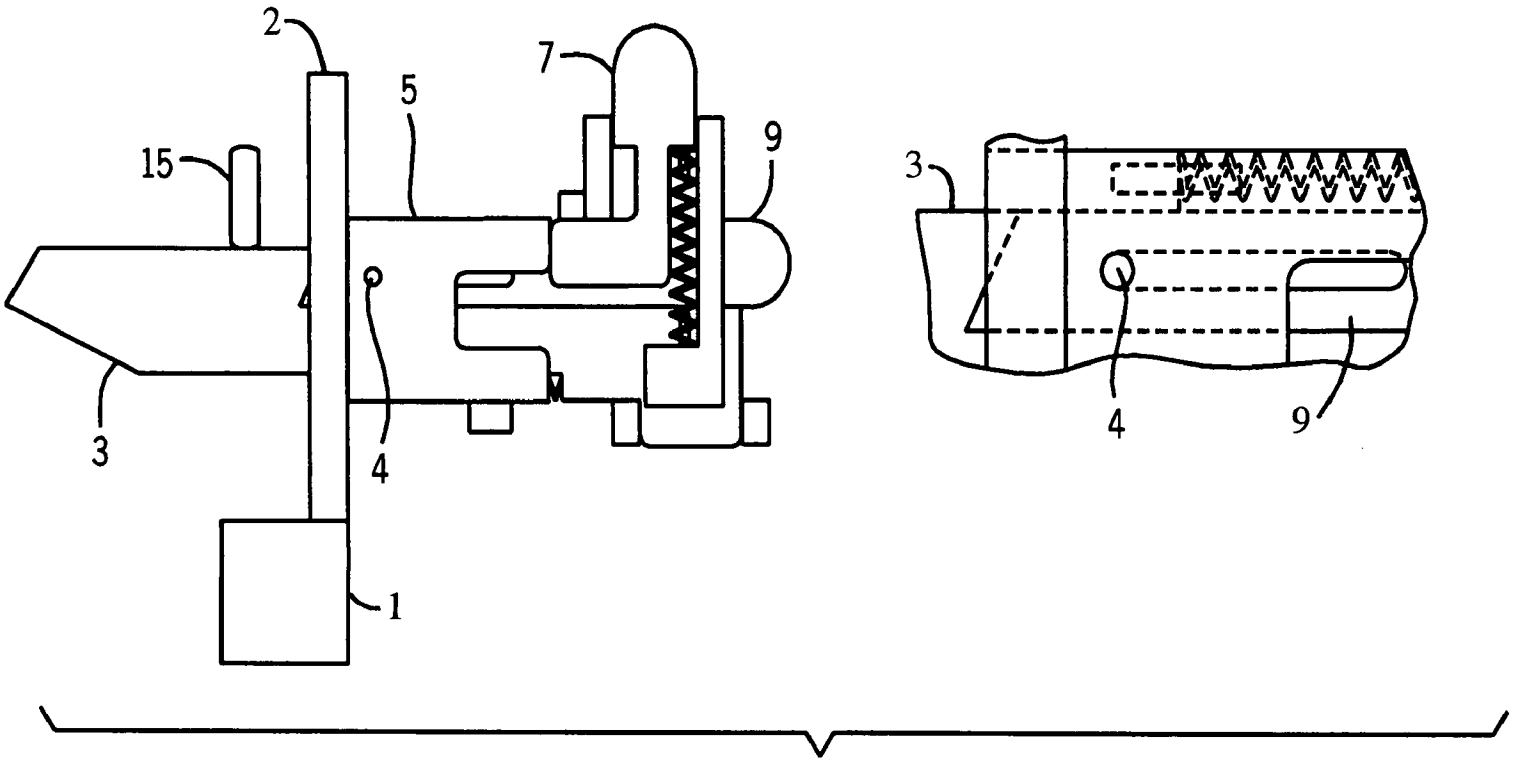
FIG. 9 is a side view and partial enlarged view of the first key mechanism where the key is in the cylinder bolt lock at a conventional locking or unlocking position.
Figure 10:
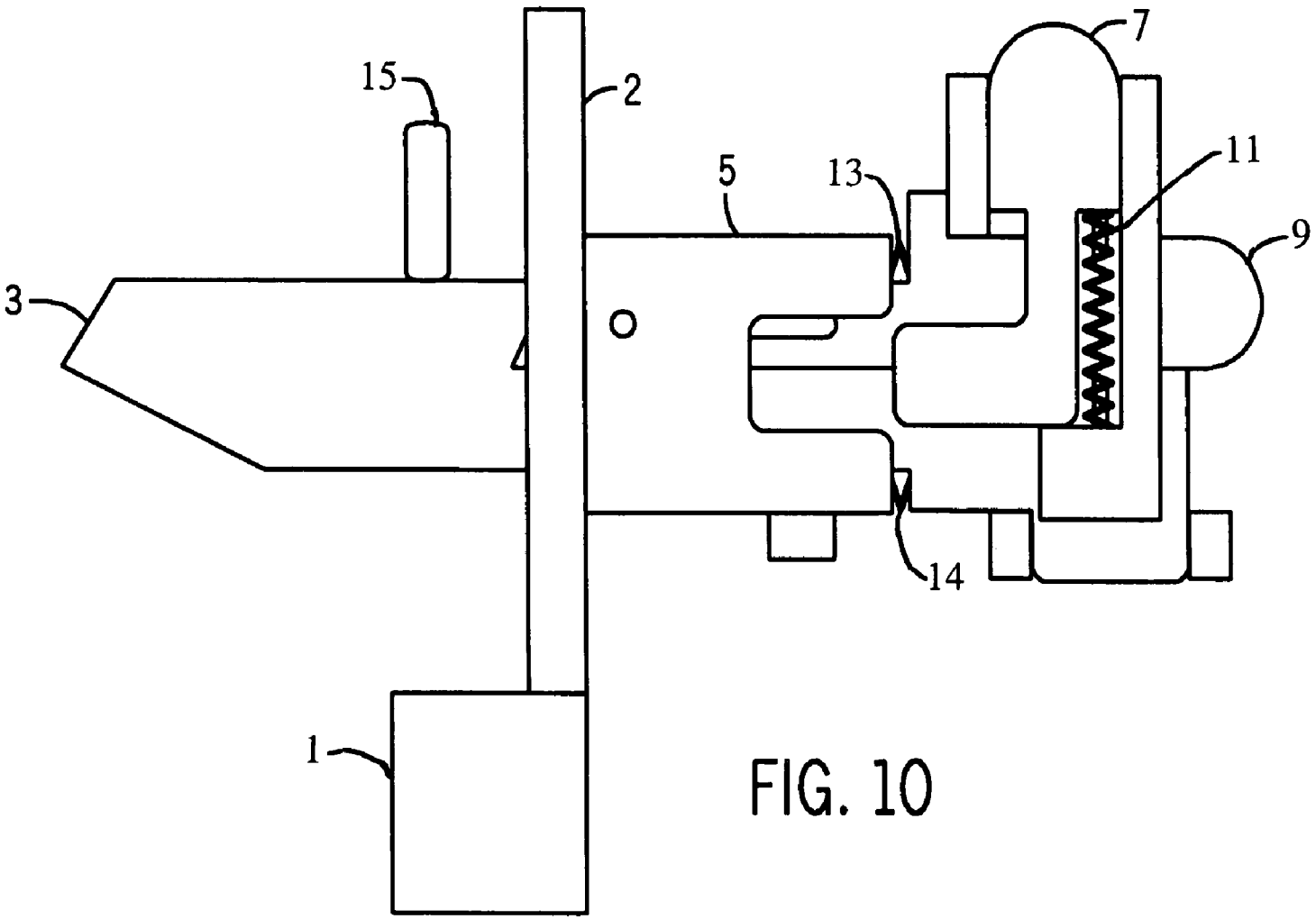
FIG. 10 is a side view of the first key mechanism where the key is in the locking or unlocking position with the T-latch pushed down.
Figure 11:
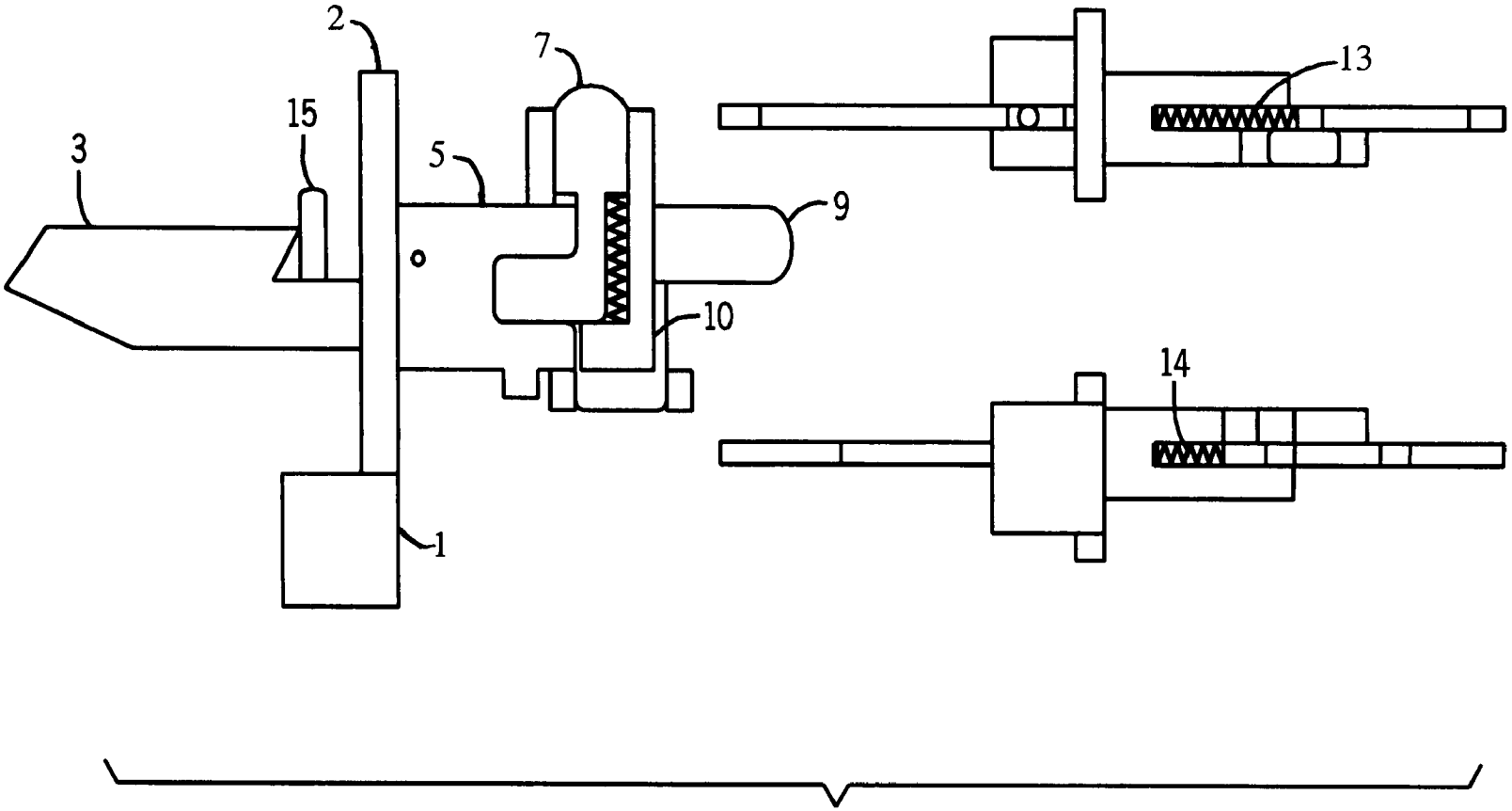
FIG. 11 is a side, top and bottom view of the first key mechanism, secured to the cylinder bolt lock by a tumbler bolt of the cylinder bolt lock.
Figure 12:
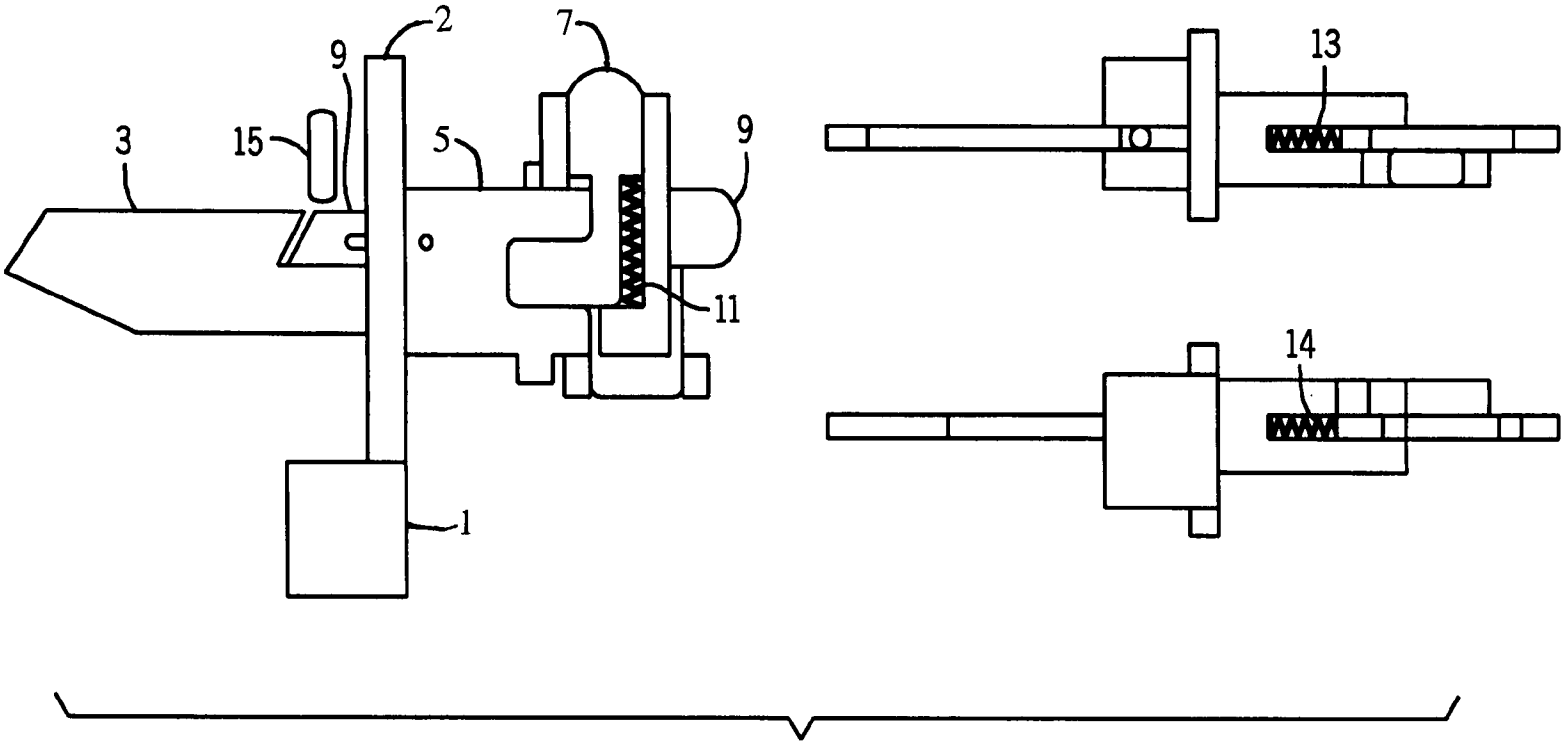
FIG. 12 is a side, top and bottom view of the first key mechanism, where the tumbler driver is actuated to lift the tumbler out of the slot so that the key can be removed from the secured position.

FIGS. 8 and 9

These figures show how the butt end 5 of the key is locked by the T-latch 7 that has not been pressed down. The bolt driver 9 cannot be moved to form a slot because it is locked with the pin 4 which, in this position, is at the limit of the bolt driver slot (see partial view), preventing the bolt driver 9 from moving backwards. FIG. 8 shows the key partially inserted into the lock 2.

Upon inserting the key blade 3 in the cylinder bolt lock 2, as shown in FIG. 9, it strikes with the butt end 5 of the key mechanism. In this position, the key unlocks or locks the cylinder like a conventional key. While not shown, the key blade 3 conventionally includes a unique combination of notches into which respective tumblers 15 fall for the correct combination to allow the cylinder of the bolt lock to rotate.

FIG. 10

Upon pressing the T-latch 7, a portion thereof can enter into the butt end 5 so that the key blade 3 is free to slide a little more inside the cylinder of the bolt lock 2, past the proper combination between the tumblers 15 and the notches in the key blade 3. The key blade 3 cannot thus rotate the cylinder, even from the other side, if so desired.

FIG. 11

The securing action is accomplished when movement of the key blade 3 gets blocked by the tumbler 15, which prevents removal of the key, thereby fixing it outphased from the correct combination, until the tumbler 15 is released by the tumbler driver 9. The bottom spring 14 biases the key to return it back to its normal position, which is accomplished when the bolt tumbler driver 9 is actuated.

FIG. 12

Upon pushing the tumbler driver 9 toward the cylinder bolt lock 2, the top spring 13 is compressed, the tumbler 15 is driven out of the slot, and the key is released. At this moment, the key can be pulled, whereupon the spring 14 returns the key back in place, the spring 11 returns the T-latch 7 back in place, restoring the limits of the normal key to open or close the cylinder bolt lock with the same key.

Mechanism 2

Figure 1:
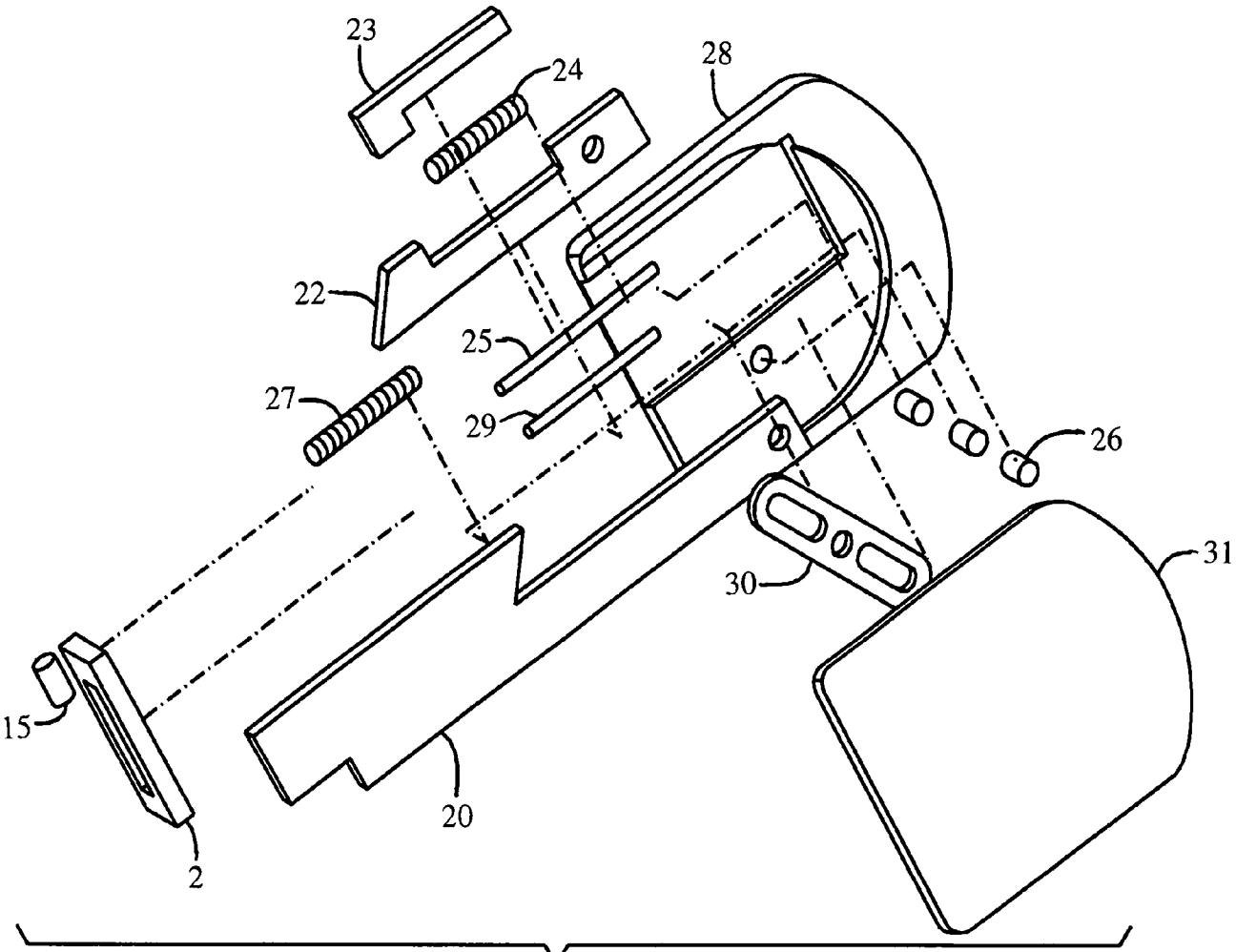
FIG. 1 is an exploded view of the second key mechanism according to the invention.
Figure 2:
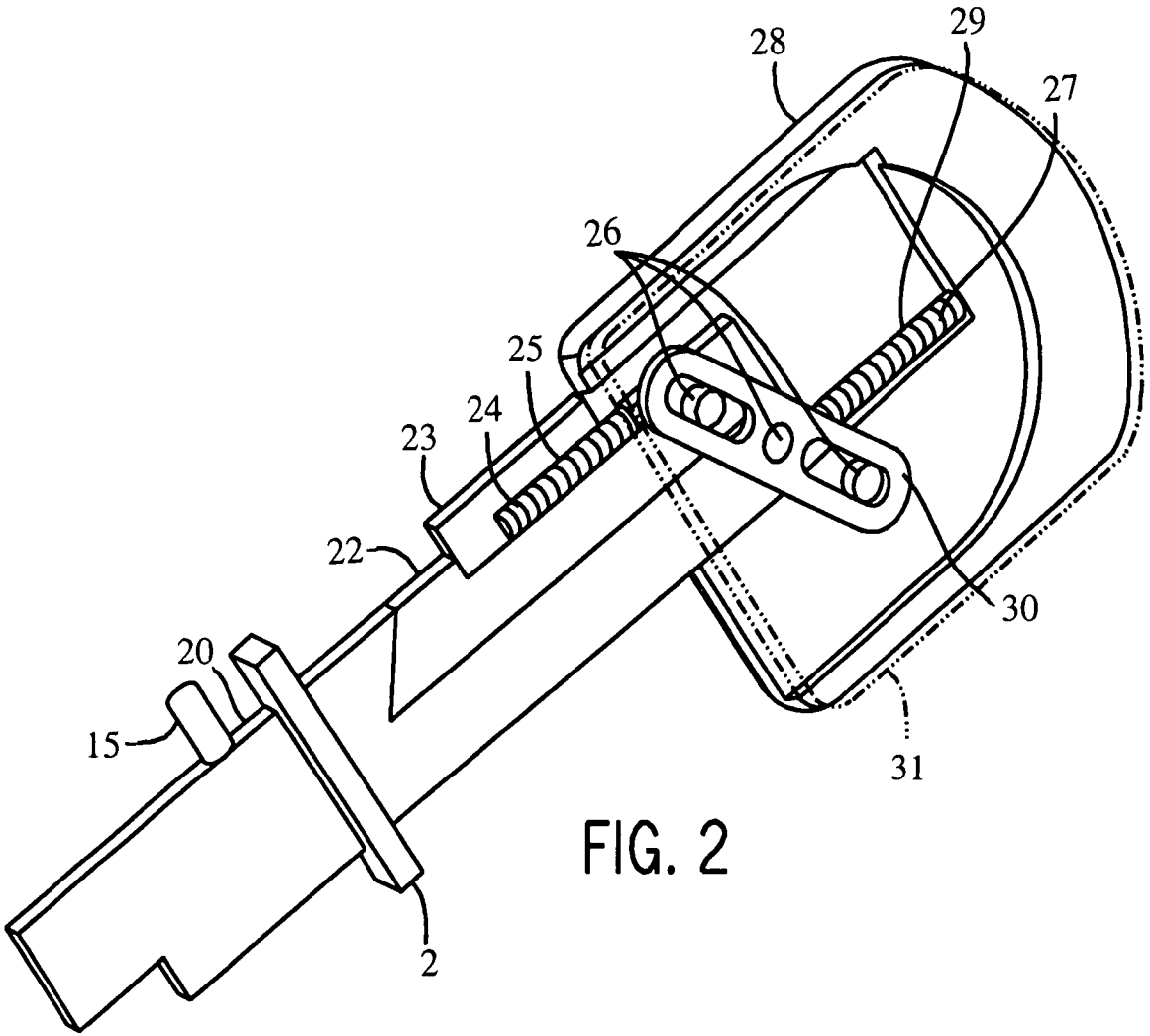
FIG. 2 is an isometric view of the second key mechanism where the key blade is being inserted into the cylinder bolt lock.

The key mechanism of FIG. 1 comprises twelve components identified in the attached figures, illustrating the different positions of the key in the cylinder bolt lock 2. FIG. 2 shows the key partially inserted into the cylinder bolt lock 2.

Figure 3:
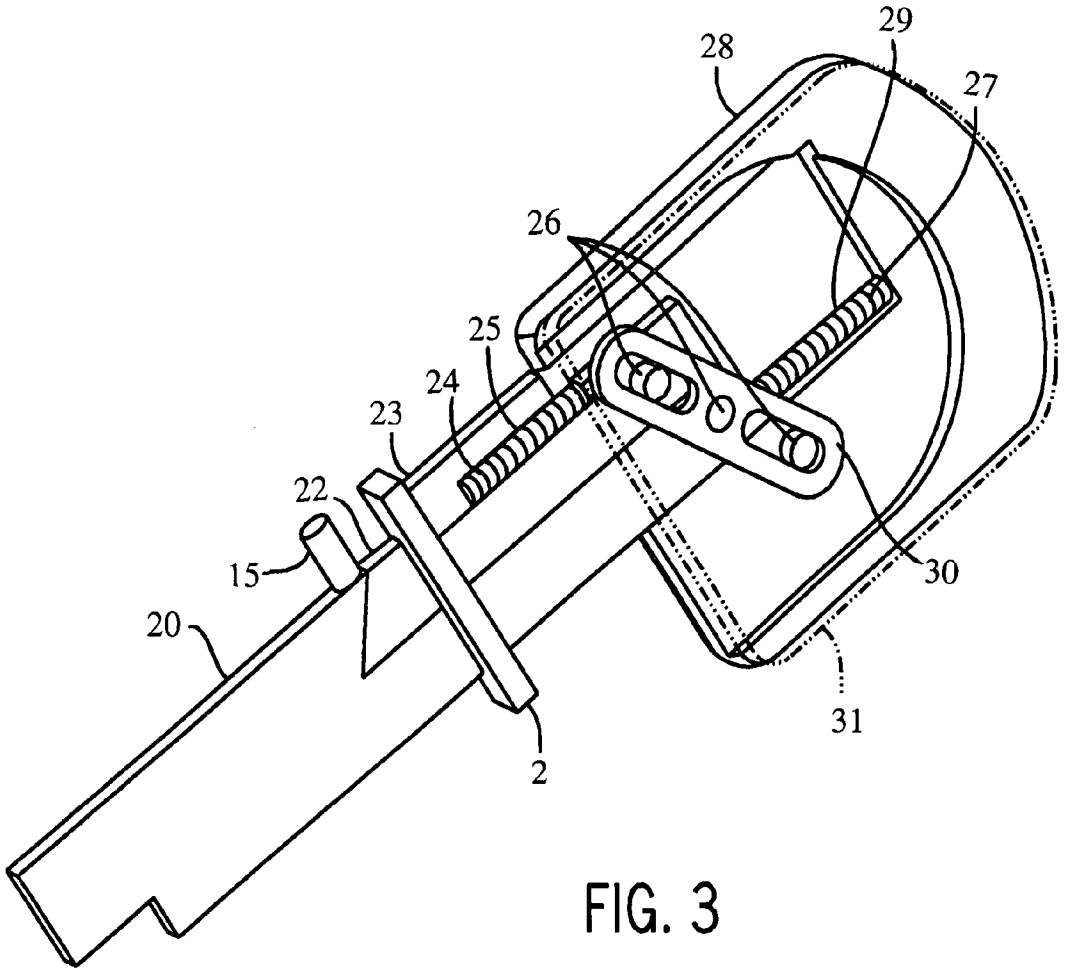
FIG. 3 is an isometric view of the second key mechanism where the key is in the conventional locking or unlocking position.
Figure 4:
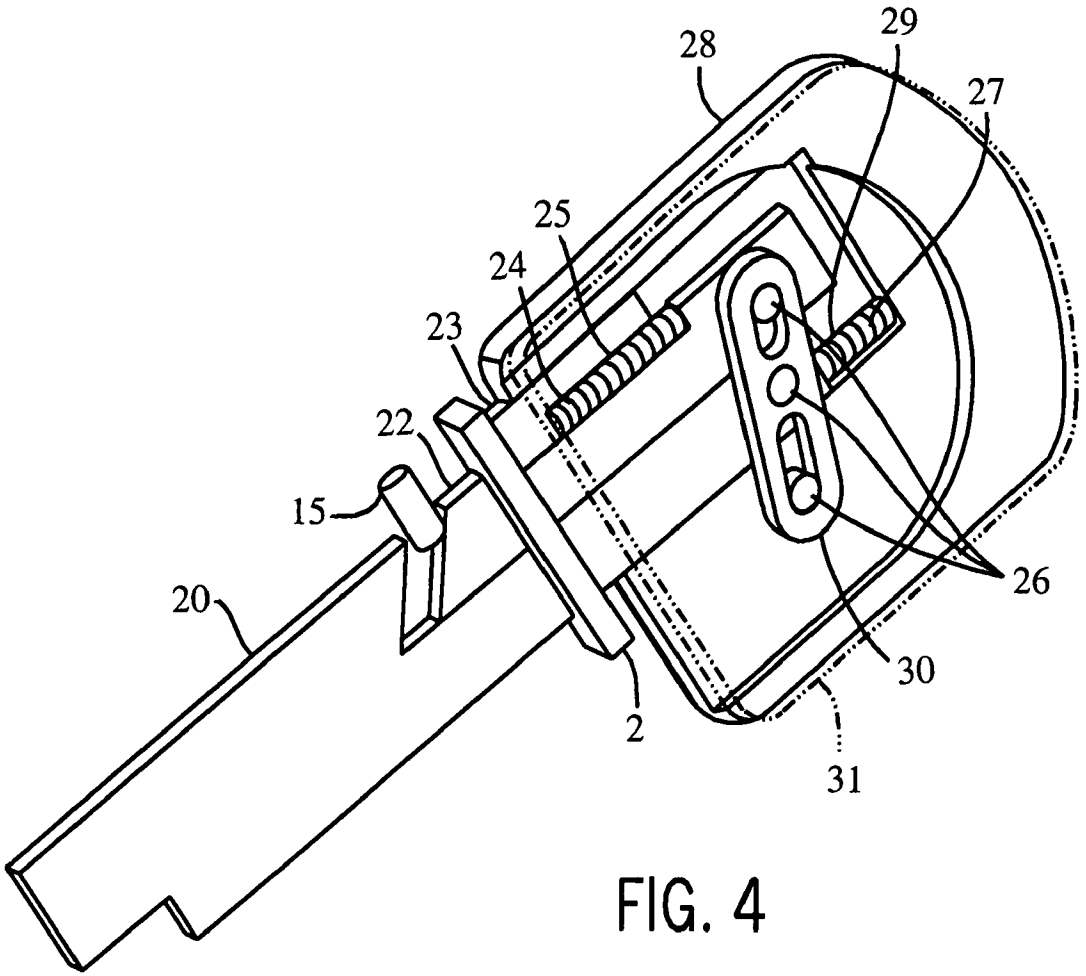
FIG. 4 is an isometric view of the second key mechanism where the key is secured within the cylinder bolt lock, and cannot be pushed out of the cylinder bolt lock.
Figure 5:
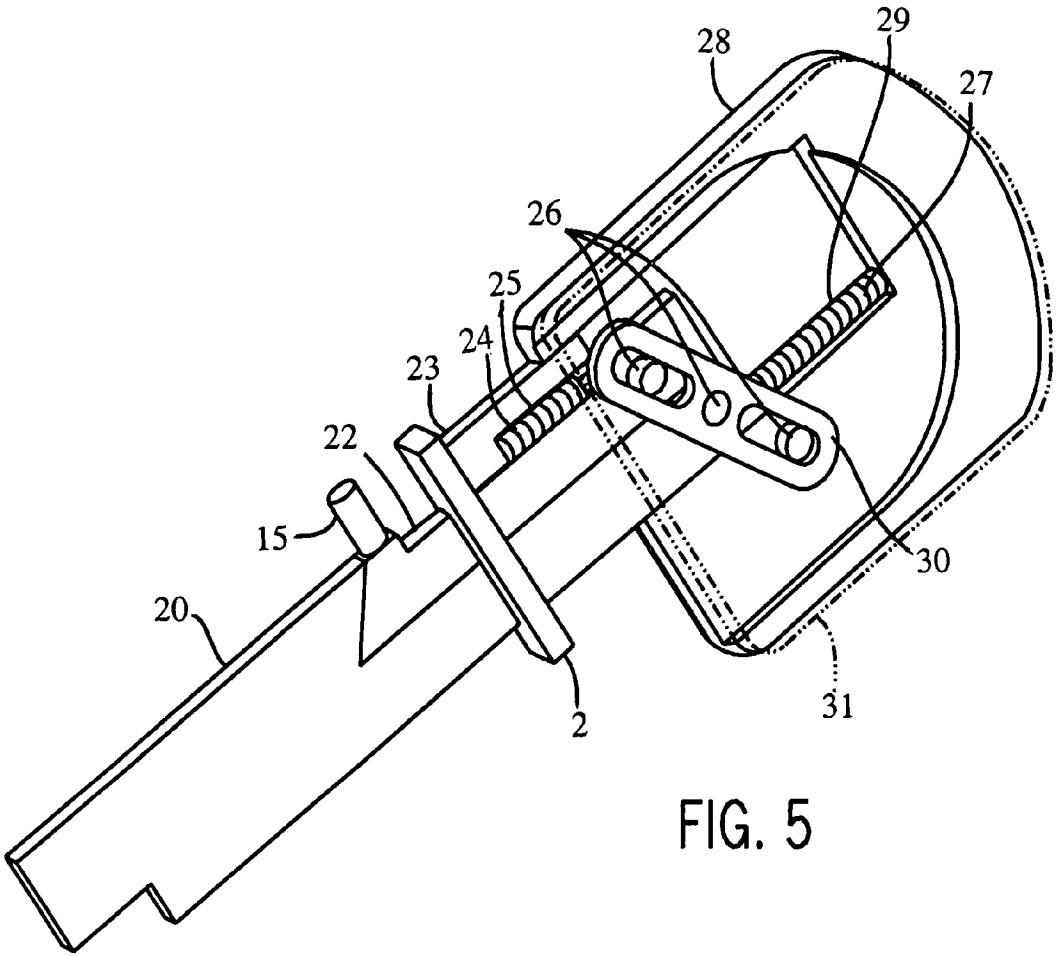
FIG. 5 is an isometric view of the second key mechanism where the key is freed from the cylinder bolt lock by actuation of the tumbler driver.

FIGS. 2 and 3

FIG. 2 shows the key partially inserted into the cylinder bolt lock 2. Upon further inserting the key blade 20 into the cylinder bolt lock 2, the butt 23 of the key strikes against the cylinder bolt lock 2. This is shown in FIG. 3. In this position, the key unlocks or locks the cylinder bolt lock 2 like a conventional key.

FIG. 4

By pushing the key further inside the cylinder bolt lock 2, after striking the butt 23, the cylinder locking position is activated. The butt 23 is then fixed in place due to the spring 24, while the mounting bracket 28 of the key moves further. This further movement of the key mounting bracket 28 rotates the lever 30 which pushes the key blade 20 further into the cylinder bolt lock 2.

Upon pushing the key, a space or slot opens between the key blade 20 and the tumbler driver 22, whereupon the cylinder tumbler 15 falls into the slot. This action blocks the key and prevents removal thereof from the cylinder bolt lock 2.

FIG. 5

Upon pulling the mounting bracket 28 of the key, the lever 30 rotates in the opposite sense, pushing forward the tumbler driver 22, thus lifting the cylinder tumbler 15. When the cylinder tumbler 15 is lifted, the key is released and can be removed from the cylinder bolt lock 2.

The first key mechanism (FIGS. 6-12) comprises the following parts:

(1) Part of door: the part holding the cylinder-type bolt lock, (2) Cylinder bolt lock: the key slot in the lock, (3) Key blade: the part of the key having tumbler notches therein, (4) Pin: limits movement of the tumbler driver, (5) Butt end: engages cylinder bolt lock when the key is inserted into the cylinder bolt lock to lock and unlock it, (6) Guide: for guiding the T-latch, (7) T-Latch: fixes the key position when pushed down, (8) Spring guide: guides the spring 11, (9) Tumbler driver: is moved to lift the tumbler out of the slot,

(10) Guide: guides the T-latch,

(11) Spring: applies spring bias to T-latch,

(12) Base: registers the key blade in the key housing,

(13) Spring: spring biases the tumbler driver and key blade,

(14) Spring: spring biases the butt end and the key blade, and

(15) Tumbler: part of the cylinder bolt lock.

The second key mechanism (FIGS. 1-5) comprises the following parts:

(20) Key blade: part of key with combination notches to lock and unlock a cylinder-type bolt lock,

(22) Tumbler driver: drives the tumbler out of the slot in the key,

(23) Butt: abuts the cylinder bolt lock in the normal key position,

(24) Spring: allows operation of the tumbler driver,

(25) Guide pin: guides the spring 24,

(26) Axle pins (three pieces): they allow operation of the lever,

(27) Spring: returns everything back to the normal key position,

(28) Mounting bracket: holds the components of the key,

(29) Key guide pin: guides the key,

(30) Lever: actuates the key mechanism,

(31) Key cover: covers the mounting bracket and components of the key, (2) Cylinder bolt lock: part of the lock, and

(15) Cylinder tumbler: part of the cylinder bolt lock.

Having thoroughly described the invention, I consider it as a novelty and therefore claim as my sole proprietorship the contents of the following claims:

The invention claimed is:

1. A key mechanism for locking and unlocking a cylinder of a bolt lock of the type having tumblers, the key mechanism comprising:

a key mounting bracket for grasping by a person using said key mechanism;

a key blade attached to said mounting bracket, said key blade having notches which, together with the tumblers of the cylinder bolt lock, provide a unique combination for opening the cylinder bolt lock;

said key mechanism having a slot that can be opened and closed by manipulation of said key mechanism so that a respective tumbler of the cylinder bolt lock can fall into said slot when open, and said tumbler can be lifted from said slot during closing of said slot; and said key mechanism constructed to be insertable into the cylinder bolt lock to a first position wherein the cylinder bolt lock is operable to be locked and unlocked, and insertable to a second position wherein a tumbler of the cylinder bolt lock enters into the open slot in said key mechanism, thereby preventing the key from being removed from the cylinder bolt lock.

2. The key mechanism of claim 1, further including a T-latch, and wherein said key mechanism is movable from the first position to the second position by pushing the key further into the cylinder bolt lock and then pressing said T-latch downwardly and pushing said T-latch forwardly until the tumbler enters into the open slot in said key mechanism.

3. The key mechanism of claim 1, further including a tumbler driver operable with said key blade to open and close the slot, and wherein said key mechanism is removable from the second position by operating said tumbler driver, said tumbler driver being operable to drive the tumbler out of the open slot in the key mechanism, thereby releasing the key mechanism.

4. The key mechanism of claim 3, further including a T-latch operably moved between an initial position and a pushed position, and wherein removal of the key mechanism from the cylinder bolt lock permits the T-latch to return to the initial position, thereby resetting the key mechanism for further usage.

5. The key mechanism of claim 1, wherein the key mechanism is movable from the first position to the second position by pushing the key mechanism further into the cylinder bolt lock.

6. The key mechanism of claim 1, further including a lever and a tumbler driver operable with said key blade to open and close the slot, and wherein pushing the key mechanism further into the cylinder bolt lock causes the tumbler driver to rotate said lever until a slot opens between said key blade and the tumbler driver such that the tumbler enters the slot, thereby locking the key mechanism into the second position.

7. The key mechanism of claim 6, wherein the key mechanism is constructed so as to be removable by pulling the mounting bracket, thereby causing said lever to rotate to thereby push the tumbler driver forwardly to remove the tumbler from the slot, thereby freeing the key mechanism.

8. A key mechanism for locking and unlocking a cylinder of a bolt lock of the type having tumblers, the key mechanism comprising:

a mounting bracket;

a lever pivotally mounted to the mounting bracket;

a butt member fixed to the mounting bracket;

a key blade slidingly located partially within the mounting bracket, the key blade being pivotally mounted to the lever; and a tumbler driver partially located within the mounting bracket and attached to the lever;

wherein as the key is inserted into a cylinder bolt lock into a first position, the butt member contacts the cylinder bolt lock so that the key is operable in this first position; and wherein, if the key blade is inserted further into the cylinder bolt lock, the lever pivots further, thereby pushing the key blade further into the cylinder bolt lock and permitting a tumbler to drop into a slot opened between the key blade and the tumbler driver to thereby fix the key mechanism in the cylinder bolt lock.

9. The key mechanism of claim 8, wherein the key blade is removable from the cylinder bolt lock by pulling on the mounting bracket which is effective to close the slot and lift the tumbler out of the slot.

10. The key mechanism of claim 8, wherein the tumbler driver is spring biased towards the lever.

11. The key mechanism of claim 8, wherein the lever is spring biased away from the mounting bracket.

12. A key mechanism for locking and unlocking a cylinder of a bolt lock of the type having tumblers, the key mechanism comprising:

a key bracket having an aperture formed therethrough;

a key blade inserted into the aperture in the key bracket;

a tumbler driver in sliding connection with the key blade;

a T-latch guide attached to the key mechanism; and a T-latch slidingly attached to the T-latch guide;

the key mechanism being insertable into the cylinder bolt lock in a first position, wherein the key mechanism is operable to lock and unlock the cylinder bolt lock like a conventional key; and wherein the key mechanism being further insertable to a second position in the cylinder bolt lock, and pressing downwardly and forwardly on the T-latch to press the T-latch into the key bracket such that a slot opens between the tumbler driver and the key blade and a tumbler of the cylinder is operable to drop into the slot.

13. The key mechanism of claim 12, wherein the key mechanism is removable from the cylinder bolt lock by pressing the tumbler driver forwardly to dislodge the tumbler from the slot.

14. The key mechanism of claim 12, wherein the T-latch is spring biased to move upwardly from the T-latch guide.

15. The key mechanism of claim 12, wherein the tumbler driver is spring biased for retraction thereof.

* * * * *